US008740451B2

(12) United States Patent
Gourdin

(10) Patent No.: US 8,740,451 B2
(45) Date of Patent: Jun. 3, 2014

(54) WATCH CASE INCLUDING AN ORIENTATION MEMORY CROWN

(71) Applicant: Rolex S.A., Geneva (CH)

(72) Inventor: Vincent Gourdin, Sciez (FR)

(73) Assignee: Rolex S.A., Geneva (CH)

( * ) Notice: Subject to any disclaimer, the term of this patent is extended or adjusted under 35 U.S.C. 154(b) by 23 days.

(21) Appl. No.: 13/672,301

(22) Filed: Nov. 8, 2012

(65) Prior Publication Data

US 2013/0114383 A1 May 9, 2013

(30) Foreign Application Priority Data

Nov. 9, 2011 (EP) ..... 11405355

(51) Int. Cl.

| | |
|---|---|
| ***G04B 3/00*** | (2006.01) |
| ***G04B 37/00*** | (2006.01) |
| ***G04B 3/04*** | (2006.01) |
| ***G04B 37/10*** | (2006.01) |

(52) U.S. Cl.

CPC ..... *G04B 3/04* (2013.01); *G04B 37/103* (2013.01)

USPC ..... 368/308; 368/319

(58) Field of Classification Search

USPC ..... 368/288–290, 319–321

See application file for complete search history.

(56) References Cited

U.S. PATENT DOCUMENTS

| | | | | |
|---|---|---|---|---|
| 5,383,166 | A * | 1/1995 | Gallay | 368/288 |
| 7,357,569 | B2 * | 4/2008 | Yoshikawa | 368/308 |
| 2002/0067665 | A1 * | 6/2002 | Ecoffet | 368/319 |
| 2003/0007426 | A1 * | 1/2003 | Ecoffet | 368/319 |
| 2004/0257917 | A1 * | 12/2004 | Yoshikawa | 368/318 |
| 2007/0025190 | A1 | 2/2007 | Cretin | |
| 2007/0147186 | A1 * | 6/2007 | Morel | 368/319 |

FOREIGN PATENT DOCUMENTS

| | | | |
|---|---|---|---|
| EP | 2182417 | A2 | 5/2010 |
| WO | 01/40881 | A1 | 6/2001 |
| WO | 2005/038538 | A1 | 4/2005 |
| WO | 2011/137544 | A2 | 11/2011 |

OTHER PUBLICATIONS

European Search Report of EPO appl. No. 11405355, mailing date of Jun. 11, 2012.

* cited by examiner

*Primary Examiner* — Vit W Miska

(74) *Attorney, Agent, or Firm* — Westerman, Hattori, Daniels & Adrian, LLP

(57) ABSTRACT

A watch case comprising:

a middle (3), a first tube (1) provided with first indexing elements (1*a*), a control crown (C) including:

a cap (4) having a distinctive sign (S) on a front face (4'), and a bushing (5) intended to be connected to the movement of the watch, a second tube (2) adapted to be fastened to the middle (3) and to receive the bushing (5), the control crown (C) and the first tube (1) including respective screwing elements (1*b*,4*b*) for screwing them together.

Second indexing elements (3*a*,3*a'*,3*a*"') fastened to the middle (3) are provided to cooperate with the first indexing elements (1*a*) of the first tube (1). The first tube (1) and the second tube (2) are conformed so that fastening the second tube (2) to the middle (3) ensures axial immobilization of the first tube (1) relative to the middle (3).

16 Claims, 5 Drawing Sheets

WATCH CASE INCLUDING AN ORIENTATION MEMORY CROWN

The invention concerns a watch case including a crown having a front face provided with a distinctive sign, this crown having the particular feature of always reverting to its initial orientation after unscrewing and then screwing. The invention also relates to a method of assembling such a watch case. The invention also concerns a timepiece, notably a watch, in particular a wristwatch, including such a case. The invention further concerns a case produced using the assembly method.

BACKGROUND OF THE INVENTION

Producing and mounting crowns screwed onto watch cases are well known.

However, for aesthetic reasons, it is preferable, if the external face of the external part of the crown features a distinctive sign, to be able to guarantee that the distinctive sign is located in a particular angular orientation relative to the longitudinal axis of the tube of the watch case to which the crown is screwed. Otherwise the angular position of the distinctive sign is random.

The published patent application EP 2 182 417 describes a screw crown composed of a cap, three distinct tubes and a locknut.

The first tube is connected to the crown and is screwed onto the second tube, the third tube is adapted to receive the second tube, and the second tube and the third tube include indexing elements.

The third tube includes internal teeth provided on the interior perimeter and arranged to cooperate with a toothed ring of the second tube. The second tube and the third tube are locked in translation by a ring and form a subassembly having an orientable external thread onto which the crown associated with the first tube is screwed.

The angular orientation is fixed once and for all and is linked directly to the number of teeth present on the second tube and the third tube, and the number of indexing positions is necessarily limited because of the small diameters of these tubes. Moreover, this solution necessitates three tubes and is difficult to fit.

Moreover, there is the risk of the crown and the tubes becoming detached from the watch case if too high a torque is applied to the crown.

The drawbacks of this crown have been overcome by the solution proposed in international application PCT/CH2011/000094 filed 28 Apr. 2011 and published with the number WO2011137544 after the present patent application was filed. The subject matter of this international application is a watch case comprising a control crown composed of two parts, namely an internal part and an external part, this latter part having to be retained in the internal part by a clamping ring.

SUMMARY OF THE INVENTION

A major object of the invention is to propose a watch case that is at least as satisfactory as that described in the aforementioned international application whilst including even fewer components.

That object is achieved by means of a watch case comprising:

a middle, a first tube provided with first indexing elements, a control crown including:

a cap having a distinctive sign on a front face, and a bushing intended to be connected to the movement of the watch, a second tube adapted to be fastened to the middle and to receive the bushing, the control crown and the first tube including respective screwing elements for screwing them together;

this watch case having the particular feature that:

second indexing elements fastened to the middle are provided to cooperate with the first indexing elements of the first tube, and the first tube and the second tube are conformed so that fastening the second tube to the middle ensures axial immobilization of the first tube relative to the middle.

In a preferred embodiment of the invention, elements are provided such that the initial angular indexing of the crown can be modified only by an operator having available a dedicated tool.

According to the invention, a watch case is defined by claim 1.

Various embodiments of a watch case are defined by claim 2 to 12 or 14.

An assembly method according to the invention is defined by claim 13.

A timepiece according to the invention is defined by claim 15.

BRIEF DESCRIPTION OF THE FIGURES

Other features and advantages of the invention will now be described in detail in the following disclosure, which is given with reference to the appended figures, which represent diagrammatically.

DETAILED DESCRIPTION OF THE INVENTION

A first embodiment of the invention is represented in FIGS. 1 to 6.

The watch case according to the invention includes a middle 3 on which a first tube 1 is mounted in a through-hole bored in the middle band. Rotation of the latter tube is prevented by teeth 1*a* thereon that are clearly visible in FIG. 2, situated on part of its perimeter and circumferentially distributed, each of which teeth extends axially, interengaged axially between teeth 3*a* that are clearly visible in FIG. 3 and are produced by broaching in the hole in the middle 3, from the exterior side thereof.

Axial immobilization of the first tube 1 relative to the middle 3 is effected thanks to an internal shoulder forming a first bearing surface 1*c* on which bears a second bearing surface 2*c* formed by a complementary external shoulder of a second tube 2. The latter tube is screwed fully home in the middle 3 in such a way as to press the interior axial end of the first tube 1 against an annular seal 7 and simultaneously to press an abutment surface 1*d* (FIG. 4) against a stop surface 3*d* provided in the hole in the middle 3. Axial immobilization of the first tube 1 relative to the middle 3 is thus ensured by cooperation, notably obstacle type cooperation, of an abutment surface 1*d* and a stop surface 3*d* provided on the middle 3. Axial immobilization of the first tube 1 relative to the middle 3 in the other direction is ensured by cooperation, notably obstacle type or contact type cooperation, of the first bearing surface 1*c* and the second bearing surface 2*c*.

Figure 5:
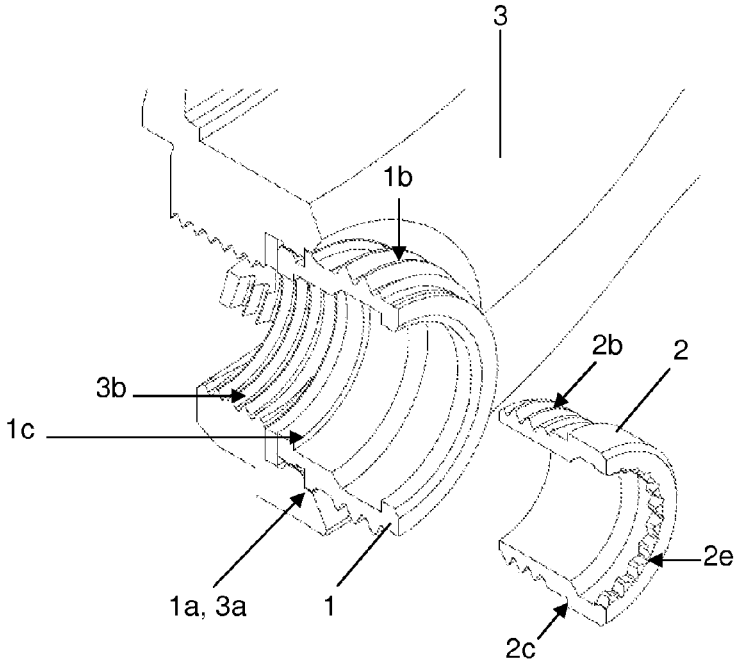
FIG. 5: the watch case from FIG. 1 on which the first tube is angularly positioned and before assembling the second tube and the cap, in axial section and in perspective as seen from the right.
Figure 6:
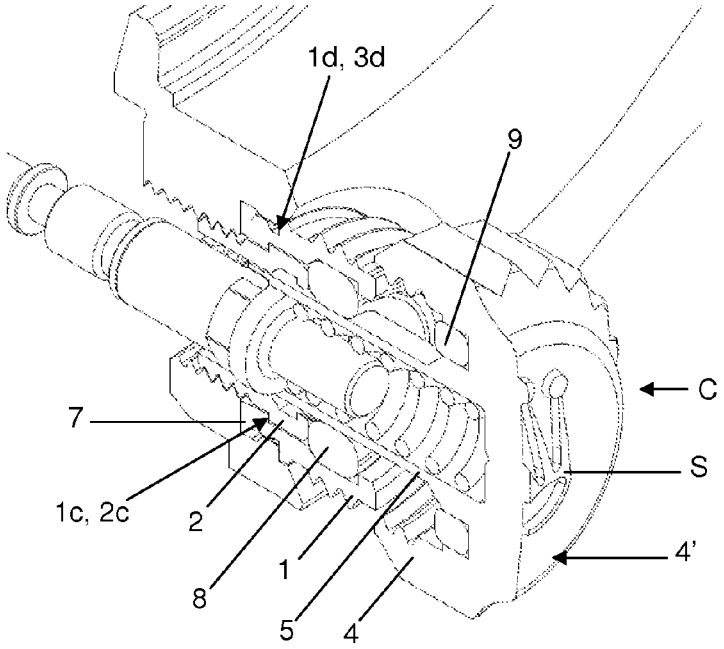
FIG. 6: the watch case from FIG. 1, the cap being unscrewed, in axial section and in perspective as seen from the right.

The second tube 2 is preferably screwed in with the aid of a special tool that is conformed to interengage with teeth 2*e* visible in FIG. 5 and provided at the exterior axial end of the second tube 2.

The first tube further includes, over a part of its periphery, an external thread 1*b* cooperating with an internal thread 4*b* produced in an annular recess provided in the cap 4 of a control crown C. On the front face 4' of the cap 4 visible from the outside is a distinctive sign S such as a brand or logo.

Figure 1:
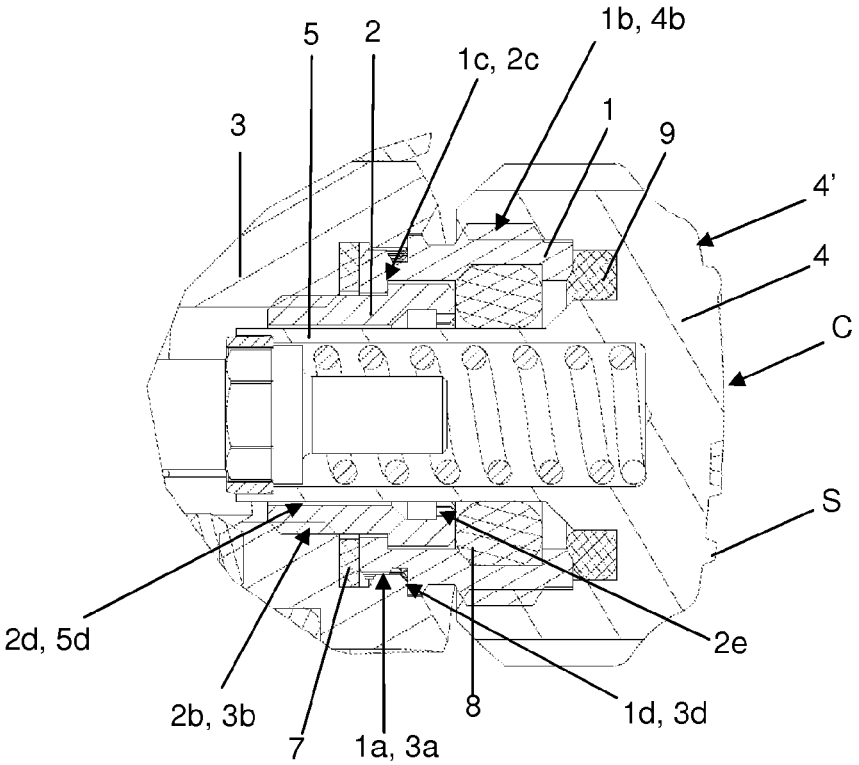
FIG. 1: a partial view in section on the axis of axial symmetry of the control crown C of a watch case of a first embodiment of the invention.
Figure 2:
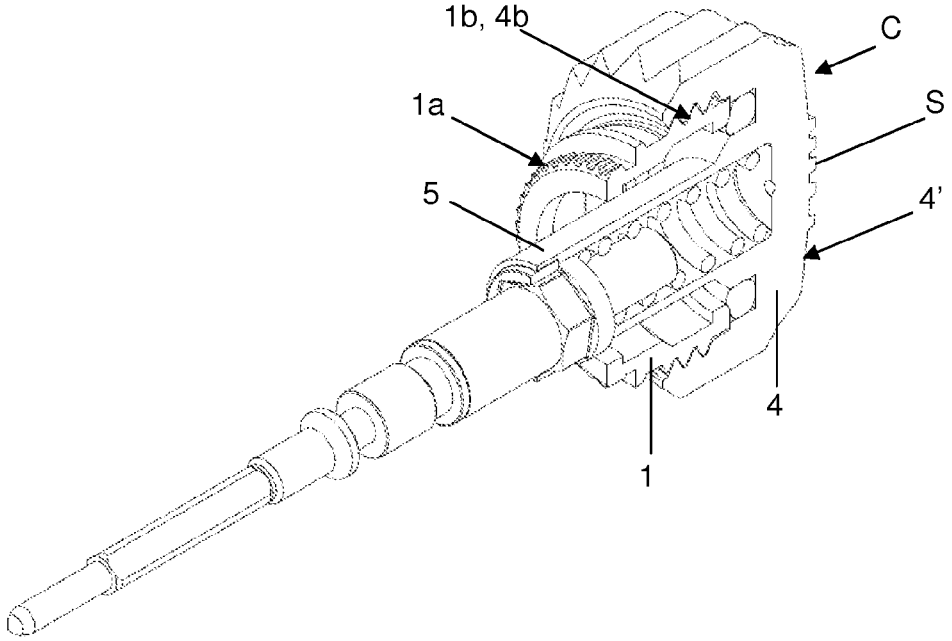
FIG. 2: the control crown C and the first tube of the watch case from FIG. 1, in perspective as seen from the left.

As clearly seen in FIG. 2, the interior of the control crown C includes, at the center of the aforementioned annular recess, a bushing 5 that is connected to the movement of the watch by known means and which is accommodated and guided axially in the second tube 2, inside which it slides (cf. FIG. 1).

Operation

The control crown C is generally mounted on the watch case in the following manner:

- the annular seal 7 is placed in the hole in the middle 3,
- the cap 4 of the control crown C is screwed fully home on the first tube 1, after which indexing is effected, i.e. the orientation of the sign S is chosen, and the resulting assembly is inserted into the hole in the middle 3, causing the teeth 1*a* of the first tube 1 to slide axially between the teeth 3*a* of the middle 3 (FIG. 4);
- the cap 4 is then unscrewed from the first tube 1 with the latter tube held in the hole in the middle 3 so that it retains its orientation (FIG. 5);
- the second tube 2 is then inserted into the tube 1 (FIGS. 5 and 6) and screwed fully home in the hole in the middle 3 until the first tube 1 is immobilized axially by the abutment surface 1*d* coming into contact with the stop surface 3*d* of the middle 3; also in contact at this time are:
  - the first bearing surface 1*c* and the second bearing surface 2*c*, and
  - the interior axial end of the first tube 1 and the annular seal 7;
- a second annular seal 8, if one is used, is placed inside the tube 1, between the exterior axial end of the second tube 2 and the interior axial end of the first tube 1;
- a third annular seal 9, if one is used, is placed inside one end of the annular recess in the cap 4;
- the bushing 5 is then connected to the movement of the watch and the cap 4 is screwed onto the first tube 1; after it is screwed on, the sign S is correctly oriented, i.e. it is oriented as was determined at the time of angular positioning, placement and axial immobilization of the first tube 1.

Thus the control crown C will retain its orientation, in the sense that afterward, after each time it is unscrewed and screwed on, the sign S will be correctly oriented.

The first tube 1 around the second tube 2 and projecting out of the latter tube, it is not easy for a user to obtain access to the second tube 2 and unscrew it. If teeth 2*e* are provided at the interior or exterior end of the second tube 2, only a qualified watchmaker having an appropriate tool can unscrew the second tube 2.

Figure 7:
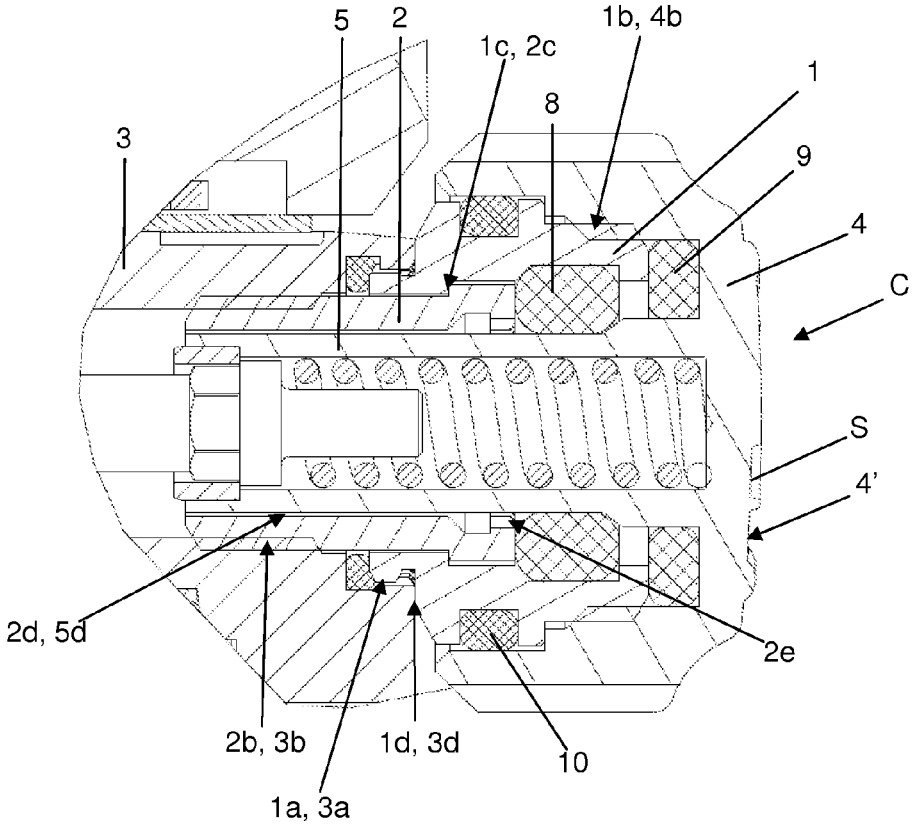
FIG. 7: a partial view in axial section of a variant of the watch case of the first embodiment of the invention.

In FIG. 7 is represented a variant of the first embodiment in which, in order to reinforce the seal, an annular seal 10 is disposed in an annular groove produced at the exterior perimeter of the first tube 1 on which the external thread 1*b* is produced.

Figure 8:
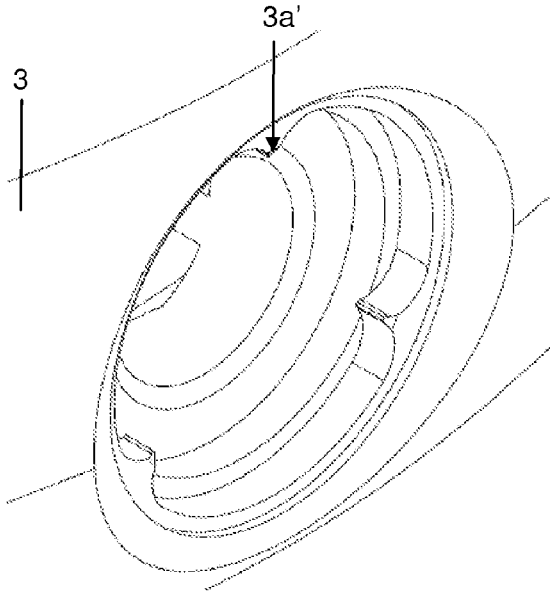
FIG. 8: a perspective view from the right of a variant of the middle indexing elements.
Figure 9:
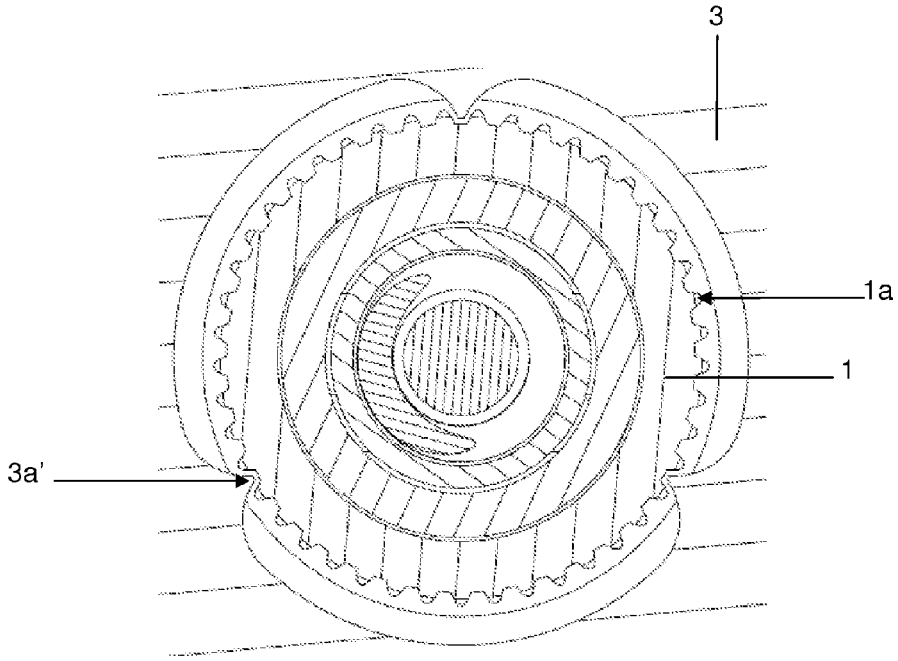
FIG. 9: a view in section as seen from the right of a watch case of the invention including the variant from FIG. 8, and FIG. 10: a partial view in axial section of a watch case of a second embodiment of the invention.

In FIGS. 8 and 9 is represented a variant of the teeth 3*a* of the middle 3.

Figure 3:
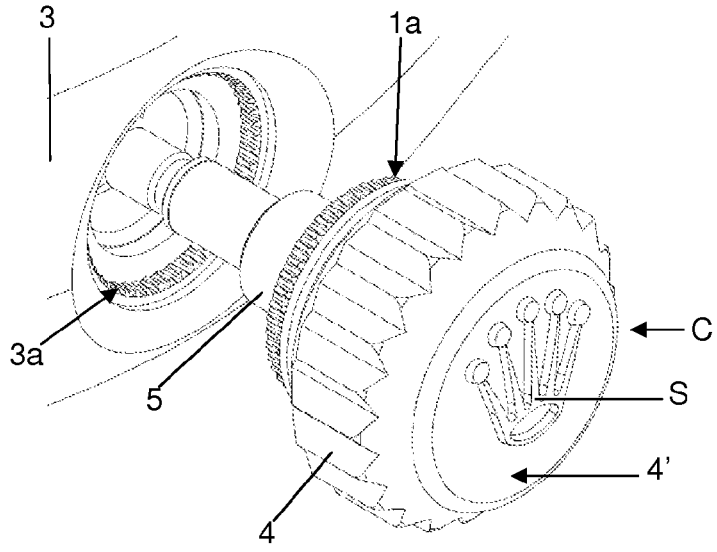
FIG. 3: the watch case from FIG. 1, in perspective as seen from the right.
Figure 4:
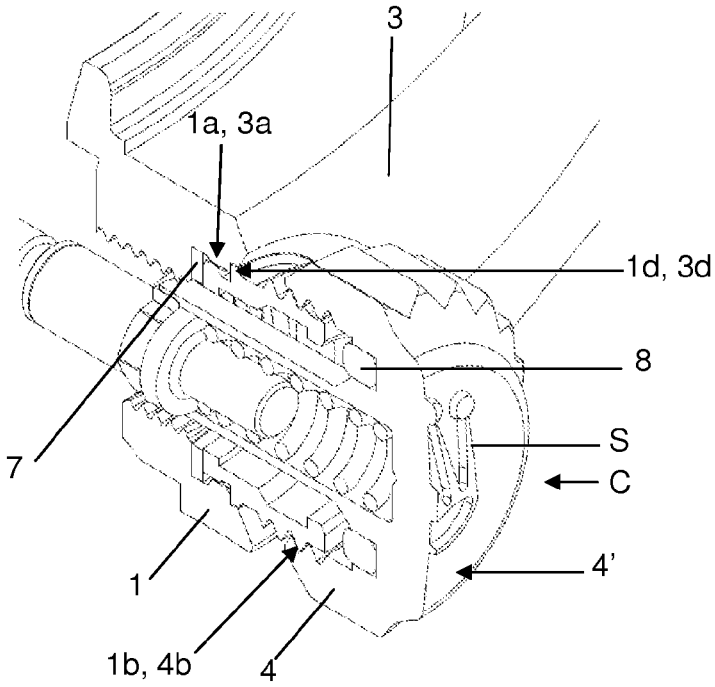
FIG. 4: the watch case from FIG. 1, during its assembly, without the second tube, in axial section and in perspective as seen from the right.

As can be seen in these figures, the teeth 3*a*', produced here by machining, comprise fewer teeth (here three teeth) than the teeth 3*a* visible notably in FIG. 3.

Figure 10:
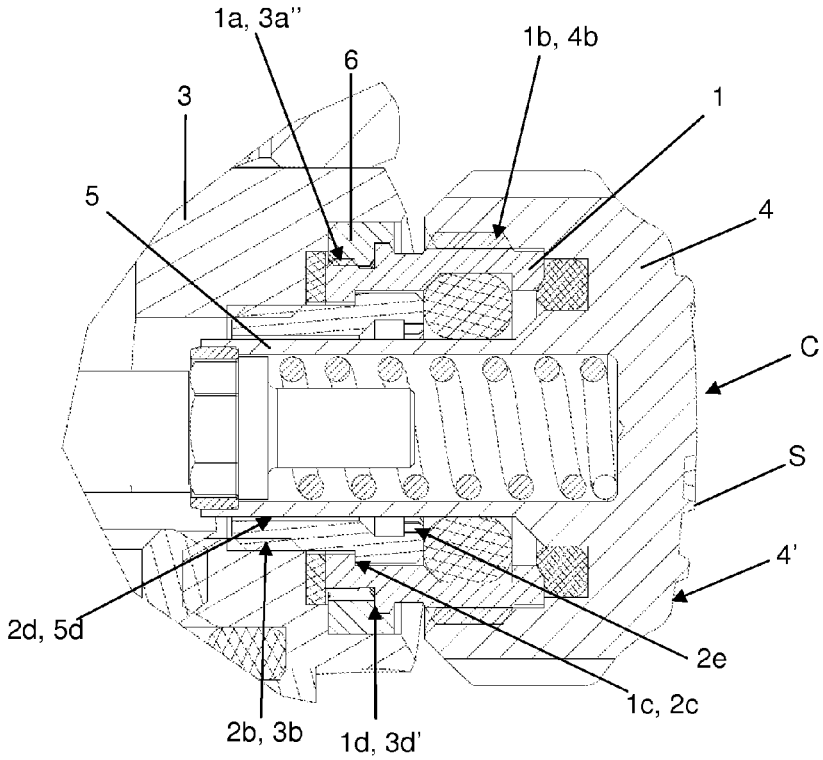

In FIG. 10 is represented a second embodiment of the invention in which, instead of providing the teeth 3*a* directly on the middle 3, teeth 3*a*" are produced on a ring 6 that has been fastened by driving it into the hole in the middle 3 (or any other appropriate means), the latter then having a recess of greater diameter than in the first embodiment. An abutment surface 3*d*' is also produced in the ring 6. The teeth 3*a*" and the abutment surface 3*d*' have the same functions as their counterparts 3*a* and 3*d*. Accordingly, in this embodiment, axial immobilization of the first tube 1 relative to the middle 3 is therefore ensured by cooperation, notably obstacle type cooperation, of an abutment surface 1*d* and a stop surface 3*d*' provided on the ring 6. Axial immobilization of the first tube 1 relative to the middle 3 in the other direction is ensured by cooperation, notably obstacle type or contact type cooperation, of the first bearing surface 1*c* and the second bearing surface 2*c*.

Other Variants

It is of course possible to make modifications to the embodiments that have just been described.

For example, rather than providing an internal thread in the control crown C and a corresponding external thread on the first tube 1, the opposite could be done (notably, external thread on the bushing 5 and corresponding internal thread in the first tube 1).

Moreover, instead of being screwed into the middle 3, the second tube 2 may be fixed to it differently, for example by driving it in. In this case, the geometry of the tube 2 is conformed in such a way as to enable its removal from the middle, for example by the addition of a groove.

The first and second indexing elements (1*a*,3*a*,3*a*',3*a*") represented in the aforementioned embodiments take the form of teeth that are circumferentially distributed and each of which extends axially on their respective member. It is entirely possible to achieve the same effects by way of edgewise teeth distributed circumferentially and extending radially on their respective member.

It is also possible to apply the variants of FIGS. 7, 8 and 9 to the second embodiment.

The placement of the annular seals in the embodiments described is optimized to guarantee the sealing of the watch case. A person skilled in the art could adapt the disposition and/or the number of these joints according to requirements and design choices.

A timepiece of one embodiment of the invention may advantageously include a watch case according to any of the embodiments and variants described above.

In this document, the expression "distinctive sign" means any visible element of the crown enabling an orientation of the crown about its rotation axis to be distinguished. The knurling or the grooves of the crown may be excluded from any such element. In other words, the expression "distinctive sign" means any visible element of the crown such that the crown does not have the shape of a body of revolution. A distinctive sign may notably comprise a marking on the crown, even if that marking is produced without significant addition of material to the crown or removal of material therefrom.

The invention claimed is:

1. A watch case comprising:

a middle (3), a first tube (1) provided with first indexing elements (1*a*), a control crown (C) including:

a cap (4) having a distinctive sign (S) on a front face (4'), and a bushing (5) intended to be connected to the movement of the watch, a second tube (2) adapted to be fastened to the middle (3) and to receive the bushing (5), the control crown (C) and the first tube (1) including respective screwing elements (1*b*,4*b*) for screwing them together;

wherein:

second indexing elements (3*a*,3*a*',3*a*") fastened to the middle (3) are provided to cooperate with the first indexing elements (1*a*) of the first tube (1), and the first tube (1) and the second tube (2) are conformed so that fastening the second tube (2) to the middle (3) ensures axial immobilization of the first tube (1) relative to the middle (3).

2. A watch case as claimed in claim 1, wherein the first tube (1) has a first bearing surface (1*c*) coming into contact with a second bearing surface (2*c*) provided on the second tube (2).

3. A watch case according to claim 2, wherein the first bearing surface (1*c*) is constituted by an internal shoulder and the second bearing surface (2*c*) is constituted by an external shoulder (2*c*).

4. A watch case as claimed in claim 2, wherein the second tube (2) is adapted to be driven into the middle (3), the second bearing surface (2*c*) coming to abut against the first bearing surface (1*c*).

5. A watch case as claimed in claim 2, wherein the second tube (2) is adapted to be screwed into the middle (3), the second bearing surface (2*c*) coming to abut against the first bearing surface (1*c*).

6. A watch case as claimed in claim 5, wherein the second tube (2) includes elements (2*e*) enabling it to be screwed/unscrewed with the aid of an appropriate tool.

7. A watch case as claimed in claim 6, wherein the elements (2*e*) are constituted by teeth provided at the same end as the control crown (4).

8. A watch case as claimed in claim 1, wherein the first and second indexing elements (1*a*,3*a*,3*a*',3*a*") are constituted by teeth conformed to interengage axially with each other.

9. A watch case as claimed in claim 1, wherein the second indexing elements (3*a*,3*a*') are provided in the middle (3).

10. A watch case as claimed in claim 1, wherein the second indexing elements (3*a*") are situated on a ring (6) fastened to the middle (3).

11. A watch case as claimed in claim 1, wherein the first tube (1) has an abutment surface (1*d*) adapted to come to abut against a stop surface (3*d*,3*d*') formed in the middle (3).

12. A watch case as claimed in claim 1, wherein the screwing elements (1*b*) of the first tube (1) are constituted by an external thread and the screwing elements (4*b*) of the control crown (C) are constituted by an internal thread formed in an annular recess provided in the control crown (C).

13. A method of assembling a watch case as claimed in claim 1, comprising the following steps:

the cap (4) of the control crown (C) is screwed fully home on the first tube (1), the sign (S) on the front face (4') of the cap (4) is oriented in a particular manner relative to the middle (3), the free end of the first tube (1) is inserted in the middle (3) by causing the first indexing elements of the first part (1), notably a teeth (1*a*), to slide axially in the second indexing elements fastened to the middle (3), notably a teeth (3*a*,3*a*',3*a*") fastened to the middle (3), the cap (4) is unscrewed from the first tube (1) with the latter tube held in the middle (3), the second tube (2) is inserted in the first tube (1), the second tube (2) is screwed in until it is immobilized axially by the abutment surface (1*d*), notably the abutment surface of the tube (1), coming into contact with the stop surface (3*d*; 3*d*'), notably the stop surface (3*d*) of the middle (3) or the stop surface (3*d*') of a ring (6) fastened to the middle, and the cap (4) is screwed fully home on the first tube (1).

14. A watch case produced by use of the assembly method as claimed in the claim 13.

15. A timepiece, including a watch case as claimed in claim 1.

16. A timepiece, including a watch case as claimed in claim 14.

* * * * *